US006666366B2

(12) United States Patent
Rosenbaum et al.

(10) Patent No.: US 6,666,366 B2
(45) Date of Patent: Dec. 23, 2003

(54) PORTABLE, INTERNAL COMBUSTION-ENGINED, SETTING TOOL

(75) Inventors: Ulrich Rosenbaum, Wangs (CH); Roman Bächtold, Igis (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/199,630

(22) Filed: Jul. 18, 2002

(65) Prior Publication Data

US 2003/0029898 A1 Feb. 13, 2003

(30) Foreign Application Priority Data

Jul. 18, 2001 (DE) ..... 101 35 031

(51) Int. Cl.[7] ..... B25C 1/04
(52) U.S. Cl. ..... 227/8; 227/10; 227/130
(58) Field of Search ..... 227/2, 8, 10, 130; 123/465 C, 46 R

(56) References Cited

U.S. PATENT DOCUMENTS 4,074,844 A * 2/1978 Hodil, Jr. ..... 227/8
4,200,213 A * 4/1980 Liesse ..... 123/46 SC
4,405,072 A * 9/1983 Kindle et al. ..... 227/10
4,534,500 A * 8/1985 Jochum ..... 227/8
5,873,510 A * 2/1999 Hirai et al. ..... 227/130
6,145,724 A * 11/2000 Shkolnikov et al. ..... 227/10
6,425,354 B1 * 7/2002 Buchel et al. ..... 123/46 R

* cited by examiner

*Primary Examiner*—Scott A. Smith
(74) *Attorney, Agent, or Firm*—Sidley Austin Brown & Wood, LLP

(57) ABSTRACT

A portable, internal combustion-engined setting tool for driving in fastening elements and including a drive piston (8), 34 a combustion chamber 1 having an inlet/outlet valve 34, located adjacent to the piston (8) and in which a fuel gas mixture is ignited for generating pressure for driving the piston (8), a locking/unlocking device (54) for closing and opening the outlet valve (34), respectively, a sensing device (55) for retaining the locking/unlocking device (54) in a locking position and having a member that is pressed against a circumference of the piston rod (10) for retaining the locking/unlocking device (54) in the locking position, and an element for positioning the member relative to the piston rod 10, when the piston (8) is not in its initial position, so that the member does not apply to the locking/unlocking device (54) a force acting in a locking direction of the locking/unlocking device.

5 Claims, 12 Drawing Sheets

PORTABLE, INTERNAL COMBUSTION-ENGINED, SETTING TOOL

BACKGROUND OF THE INVENTION

1. Field of the Invention

The present invention related to a portable, internal combustion-engined tool, in particular, to a setting tool for driving in fastening elements, and including a drive piston having a piston rod for driving a fastening element, a combustion chamber located adjacent to the piston and in which a fuel gas mixture is ignited for generating pressure for driving the piston, at least one outlet valve provided in the combustion chamber for removing flue gases; a locking/unlocking device for closing and opening the at least one outlet valve, respectively; sensing means for retaining the locking/unlocking device in a locking position and having a member that is pressed against a circumference of the piston rod for retaining the locking/unlocking device in its locking position and that is displaced, after the piston reaches its initial position, into a path of the piston rod to enable displacement of the locking/unlocking device from the locking position into an unlocking position.

2. Description of the Prior Art

In the setting tools of the type described above, the drive energy is obtained by combustion of a fuel gas mixture, which drive energy is transmitted by the drive piston to a setting element. An ignitable fuel gas mixture is fed into the combustion chamber when the setting tool is pressed against an object into which a fastening element is to be driven in. Upon actuation of a trigger, an electrical spark is generated. The electrical spark ignites the fuel gas mixture, starting a combustion process that generates energy for driving the drive piston which adjoins the combustion chamber. At the end of its displacement in a setting direction, the drive piston passes past a plurality of outlet openings through which fuel gases can partially exit. After completion of a setting process, piston returns to its initial position as a result of underpressure created in the combustion chamber by cooling of the residual gases therein. During the time the piston returns to its initial position, the combustion chamber should remain sealed from the surrounding environment. The inlet/outlet valve, through which a fresh air is admitted into the combustion chamber, should only open after the completion of the return stroke of the drive piston. The time, which is necessary for returning of the drive piston to its initial position increases, with increase of the temperatures in the setting tool. In addition, high-energy tools require a large expansion volume which again leads to increase of the time necessary for returning the piston to its initial position.

It has been proposed to control the opening of the inlet/outlet valve dependent on the position of the piston, so that the valve would open only in a predetermined position of the piston or when the piston reaches its initial position. This permitted to prevent a premature opening of the inlet/outlet valve(s) and a resulting faulty positioning of the piston due to heating or other unfavorable conditions influencing the thermal feedback that provides for the return of the piston to its initial position. With this valve control, the position of the piston is determined, e.g., with a mechanical probe which is pressed against the piston.

Nevertheless, there is still a danger that the drive piston would not reach its initial position because of an increased friction which can be caused, e.g., by accumulation of dirt. Furthermore, there can exist operational conditions which would not provide for a reliable return of the drive piston into its initial position by a thermal feedback, e.g., at an increased heating of the tool.

In case the piston occupies a faulty position, the user has to have a possibility to bring the tool into its setting or initial position. This can be done by a manual displacement of the piston which, of course, is a serious drawback as it requires time and efforts. Alternatively, the setting tool can be equipped with a special device to that end. Such a device, e.g., is described in a German Publication DE-100 32 310.

DE-100 32 310 discloses a portable, internal combustion-engined setting tool for driving in fastening elements and including a drive piston, a combustion chamber having at least one outlet valve and in which a fuel gas mixture is ignited for generating pressure for driving the piston, and a locking/unlocking device for closing and opening the at least one outlet valve, respectively; sensing means for retaining the locking/unlocking device in a locking position and having a member that is pressed against a circumference of the piston rod for retaining the locking/unlocking device in the locking position and that is displaced, after the piston reaches its initial position, into a path of the piston rod to enable displacement of the locking/unlocking device from the locking position into an unlocking position.

In this type of setting tool, one or more mechanical elements, which provide for operation of the locking/unlocking device, are arranged in a plane in which the central axis of the piston rod is located, with a mechanical probe forming a pressure contact with the piston rod. Dependent on the position of the piston, these mechanical elements occupy different positions. If the piston has not returned to its initial position, these mechanical elements are deflected, keeping the inlet/outlet valve closed by retaining the locking/unlocking device in its locking position.

If the existing faulty position of the piston, which resulted, e.g., because of an increased friction caused by a dirt contamination, should be eliminated, with the conventional locking/unlocking device being used, the device is forcefully displaced into its unlocking position, whereby the inlet/outlet valve is open. This unlocking position is retained despite the probe being pressed against the piston rod and applying a force to the locking/unlocking device acting in the locking direction of the device. The drawback of this consists in that upon occurrence of the next setting process, when the setting tool is pressed against the object, the inlet/outlet valve self-locks again as a result of the probe being pressed against the piston rod. This means that the setting tool remains in its setting condition after it is lifted off the object. Thereby, a possibility of idle setting stroke exists that presents a security risk.

Accordingly, an object of the present invention is to provide a setting tool of the type discussed above and having a high safety standard and, in particular, with which a possibility of an idle setting stroke is eliminated.

SUMMARY OF THE INVENTION

This and other objects of the present invention, which will become apparent hereinafter, are achieved, by providing, in a setting tool of the type described above, means for positioning the member relative to the piston rod, when the piston is not in its initial position, so that the member does not apply to the locking/unlocking device a force acting in a locking direction of the locking/unlocking device.

The inventive setting tool has, in comparison with conventional tools, an additional degree of freedom which permits to manually displace the member, which contacts the piston rod, out of a plane of its normal movement, normal direction of movement, to provide for displacement of the locking/unlocking device into its unlocking position. Thereby, upon being displaced into the unlocking position, the locking/unlocking device is not subjected to any force that would bias the device to its locking position. As a result, upon the setting tool being pressed against an object, no self-locking of the inlet/outlet valve takes place as no locking force is applied by the sensing means. Thus, upon lifting of the setting tool of the object, the tool is not in the setting condition anymore, and an idle setting stroke cannot take place.

According to the present invention, at an incomplete return stroke of the piston, the sensing device does not apply to the locking/unlocking device a pressure force acting in the locking direction of the locking/unlocking device. The release position of the sensing means results from the sidewise position of the probe stylus when viewed in the sensing or press-on radial direction of the prove stylus. The same object is achieved when the sensing device (the probe holder) is pivoted in the other, opposite direction from its normal position. In the sidewise position of the probe stylus relative to the piston rod, the probe stylus does not transmit any pressure to the locking/unlocking device, and the locking/unlocking device is not biased into its locking direction.

According to a further advantageous embodiment of the present invention, there is provided preload means for biasing the probe stylus into engagement with the piston rod from the sidewise position of the probe stylus. The preload means does not have any force component that would bias the locking/unlocking device to its locking position. After the piston rod returns completely to its initial position, the probe stylus can again be returned into the path of the piston rod by the preload means for performing its usual task, namely, sensing the position of the piston rod. The preload means can comprise a suitable spring element.

According to another advantageous embodiment of the present invention, the locking/unlocking device can comprise a locking lever, with the sensing device being pivotally supported on the locking lever. With the locking lever extending parallel to the longitudinal axis of the piston rod in a spaced relationship to the piston rod and pivotable in the plane of the piston rod axis, the sensing device can be pivotally supported at the free end of the lever on a pivot axle secured to the lever. The pivot axle can lie in the pivot plane of the lever and be arranged so that the axle would extend transverse or substantially transverse to the piston rod axis. In this way, the sensing device can be pivoted out of the plane of the locking lever so that the sensing device or the probe stylus is located sidewise of the piston rod, without being supported by the piston rod. In this position, the sensing device does not transmits any force to the locking/unlocking device.

For pivoting the sensing device from its normal operational position, an actuation element is provided which can be manually operated. The actuation element pivots the sensing device against the biasing force of the preload means discussed above.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
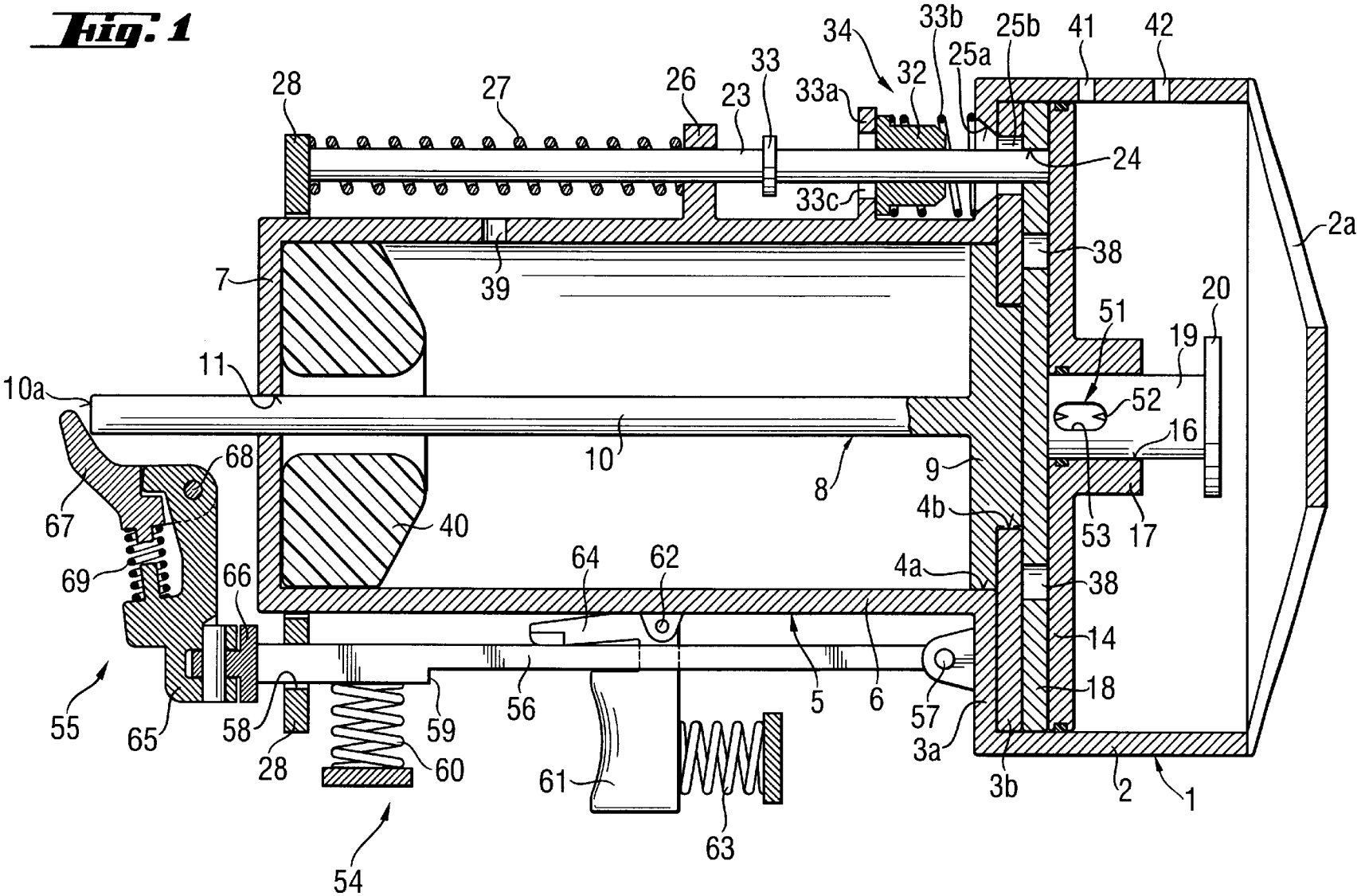
FIG. 1 an axial cross-sectional view of an internal combustion-engined setting tool according to the present invention, a combustion chamber of which is separated in several combustion chamber sections, in a completely collapsed condition of the combustion chamber sections.

FIG. 1 shows a cross-sectional view of the combustion-engined tool according to the present invention in the region of its combustion chamber. As shown in FIG. 1, a combustion chamber 1 of an inventive combustion-engined tool, in particular, of a setting tool, which is shown in FIG. 1, has a cylindrical shape and includes a cylindrical wall 2 and a ring-shaped bottom 3*a*, 3*b* adjoining the cylindrical wall 2. In the center of the bottom 3*a*, 3*b*, there is provided an opening 4*a*, 4*b*. A guide cylinder 5, which has a cylindrical wall 6 and a bottom 7, adjoins the opening 4*a*, 4*b* in the bottom 3*a*, 3*b* of the combustion chamber 1. A piston 8 is slidably displaceably arranged in the guide cylinder 5 for displacement in the longitudinal direction of the guide cylinder 5. The piston 8 consists of a piston plate 9 facing the combustion chamber 1 and a piston rod 10 extending from the center of the piston plate 9. The piston rod 10 projects through an opening 11 formed in the bottom 7 of the guide cylinder 5.

FIG. 1 shows a non-operational condition of the setting tool in which the piston 8 is in its rearward off-position. The side of the piston plate 9 adjacent to the bottom 3 of the combustion chamber 1 is located closely adjacent to the bottom 3, with the piston rod 10 projecting only slightly beyond the bottom 7 of the guide cylinder 5. The piston plate 9 has a reduced size in a direction toward the combustion chamber 1, forming a step. The section of the piston plate 9, which has a reduced diameter, extends into the opening 4*b*, with the section, which has a larger diameter being located in the opening 4*a*. Thus, the section of the piston plate 9, which has a larger diameter, impacts the bottom plate 3*b* that, thus, serves as a stop for the piston plate 9 when the piston 8 is located in its initial position. On the outer circumference of the piston plate 9, sealing rings (not shown) can be provided for sealing the space on opposite sides of the piston plate 9. Inside of the combustion chamber 1, there is provided a cylindrical plate 14 further to be called a movable combustion chamber wall or movable wall. The plane of the movable wall 14 extends transverse to the longitudinal direction of the tool. The movable wall 14 is displaceable in the longitudinal direction of the combustion chamber 1. For separating the chambers on opposite sides of the movable wall 14, an annular sealing is provided on the circumference of the movable wall. The movable wall 14 has a central opening 16, with an annular seal provided in the wall forming the opening 16.

Between the movable wall 14 and the annular bottom 3*a*, 3*b* of the combustion chamber 1, there is provided a separation plate 18. The separation plate 18 likewise has a circular shape and an outer diameter corresponding to the inner diameter of the combustion chamber 1. The side of the separation plate 18 adjacent to the movable wall 14 is provided with a cylindrical lug 19 that projects through the central opening 16 in the movable wall 14 and the length of which exceeds the thickness of the movable wall 14 in several times. The seal provided in the opening 16 engages the outer circumference of the cylindrical lug 19. At its free end, the cylindrical lug 19 is provided with a shoulder 20 the outer diameter of which exceeds the inner diameter of the opening 16 in the movable wall 14. The opening 16 is formed by a lug 17 which is connected with the movable wall 14 and surrounds the lug 19. The free end of the lug 17 faces the shoulder 20 and is spaced therefrom in the position shown in FIG. 1. An end wall 2*a*, which is connected with the cylindrical wall 2 serves as a stop for the lug 19 and thereby determines the position of the lug 19 and of the separation plate 18, which is connected with the lug 19, in the expanded condition of the combustion chamber 1.

Figure 2:
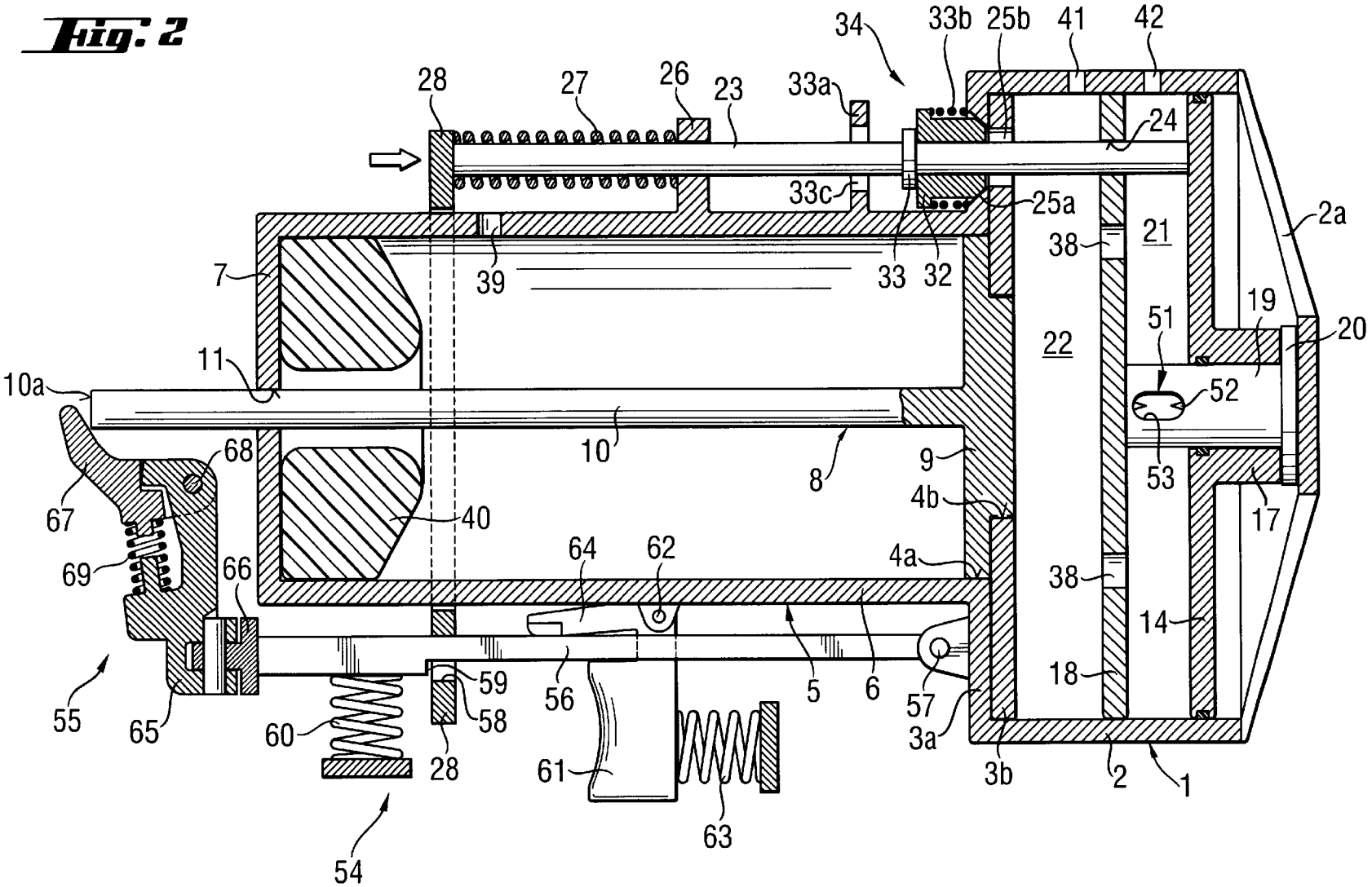
FIG. 2 an axial cross-sectional view of the setting tool shown in FIG. 1 in an expanded condition of the combustion chamber sections.

In the off position of the setting tool, which is shown in FIG. 1, the separation plate 18 lies on the bottom wall 3*b*, and the movable wall 14 lies on the separation plate 18. In this position of the setting tool, the combustion chamber is completely collapsed. When the setting tool is pressed against an object (not shown) in which a fastening element should be driven in, as it would be explained in detail further below, the movable wall 14 is lifted off the separation plate 18, becoming spaced from the separation plate 18 or the bottom wall 3*b*. After sometime, the movable wall 14 entrains the separation plate 18 with the shoulder 20, with the movable wall 14 and the separation plate 18 forming a so-called fore-chamber. The fore-chamber is a section of the combustion chamber 1 and is designated with a reference numeral 21 (FIG. 2). When the movable wall 14 is lifted further, both the movable wall 14 and the separation plate 18 are displaced parallel to each other, with formation between the separation plate 18 and the bottom wall 3*b* or the piston plate 9 of a further combustion chamber section that is called a main chamber. The main chamber is designated with a reference numeral 22 (FIG. 2). FIG. 2 shows both the fore-and main chambers 21, 22 in their completely expanded condition, with the shoulder 20 of the lug 19 engaging the end wall 2*a*.

For displacing the movable wall 14, there are provided several, e.g., three drive rods 23 uniformly distributed along the circumference of the movable wall 14 and fixedly connected therewith. Only one of the drive rods 23 is shown in FIG. 1. The drive rods 23 extend parallel to the axis of the combustion chamber 1 and outside of the cylindrical wall 6 of the guide cylinder 5. The drive rods 23 extend through openings 24, respectively, formed in the separation plate 18 and through corresponding openings 25*a*, 25*b* formed in the bottom 3*a*, 3*b* of the combustion chamber 1. The openings 25*a*, 25*b* simultaneously function as valve openings and have, in the region of the opening 25*a*, a conical profile. The drive rods 23 and the movable wall 14 can be connected with each other, e.g., by screws. The free ends of the drive rods 23 are connected with each other by a drive ring 28 that is arranged concentrically with the axis of the combustion chamber 1 and surrounds the guide cylinder 5. The drive ring 28 can likewise be connected with the drive rods 23 by screws. Respective compression springs 27 are provided between the drive ring 28 and a fixed shoulder 26 provided on the guide cylinder 5, with the drive rods 23 extending through the shoulder 26. The compression springs 27, by acting on the drive ring 28, tend to pull the movable wall 14 toward the bottom wall 3*b*.

As it has already been mentioned above, there are provided in the region of the bottom 3*a*, 3*b*, openings 25*a*, 25*b* which serves as valve openings, of which openings 25*a* have a conical profile. In each of the openings 25*a*, a valve tappet 32 sealingly extends. In the open condition of the openings 25*a*, 25*b*, the valve tappets 32 are located outside of the combustion chamber 1 or beneath the bottom wall 3*a*. In this position, the valve tappets 32 are blocked by a shoulder 33*a* fixedly secured on the guide cylinder 5. Compression springs 33*b*, which are provided between edges of the respective openings 25*a* and the valve tappets 32, press the valve tappets 32 against the shoulder 33*a*. When the drive ring 28 is pushed in a direction toward the bottom wall 3*a*, shoulders 33, which are provided on the drive rods 23, entrain the respective valve tappets 32, carrying them against the pressure applied by the springs 33*b* into the respective openings 25*a*, closing respective valves which are generally designated by a reference numeral 34. The valve 34 are inlet/outlet valves. It should be understood that a single valve 34 can be used.

The shoulders 33, which are provided on respective drive rods 23 are displaced, during the displacement of the drive rods 23, through respective openings 33*c* formed in the shoulder 33*a*. The shoulders 26 and 33*a* can be formed as separate projections.

The separation plate 18 have a plurality of circumferentially arranged openings 38 which can be equidistantly spaced from the axis of the combustion chamber 1. At the lower end of the guide cylinder 5, there are provided, in the wall 6, a plurality of outlet openings 29 for venting air out of the guide cylinder 5 when the piston 8 moves toward the bottom 7 of the guide cylinder 5. At the lower end of the guide cylinder 5, there is provided damping means 40 for damping the movement of the piston 8. When the piston 8 passes past the openings 39, flue gases can flow out there through.

In the cylindrical wall 2 of the combustion chamber 2, there are provided two, axially spaced from each other, radial openings 41, 42. Through the openings 41, 42 a liquefied fuel gas can flow into the yet not completely expanded, fore- and main chambers 21, 22. Appropriate metering valves can be connected with the radial openings 41, 42. Thereby, a predetermined a mount of a fuel gas mixture can be provided in the fore- and main chambers 21, 22.

FIG. 2 shows, as it has already been mentioned above, the setting tool with a completely expanded combustion chamber 1,i,e., with the fore-and main chambers 21, 22 in their expanded condition. The respecting displacement positions of the movable wall 14 and the separation plate 18 are defined by the position of the valve tappets 32 in the openings 25*a*. When the valve tappet 32 are completely inserted into the openings 25*a,* they prevent, due to their engagement with the shoulders 33 on the drive rods 23, further displacements of the drive of the drive rids 23 and, thereby, of the movable wall 14 which is fixedly connected with the drive rods 23. The position of the separation plate 18 is defined by engagement of the lug 19 with the end wall 2*a*. It is noted that the valve tappets 32 has a conically formed section complementary to the conical profile of the openings 25*a*.

At the end of the cylindrical lug 19 adjacent to the separation plate 18, there is provided a cage 51 in which an ignition device 52 is received. The ignition device 52 generates an electrical spark for igniting the fuel gas mixture in the forechamber section 21. The ignition device 52 is located in the central region of the cage 51 the circumference of which is provided with a plurality of openings 53 through which a laminar flame front can exit from the cage 51 into the forechamber 21.

As shown in FIG. 1, sidewise of the guide cylinder 5, there is provided a locking/unlocking device 54 connected with a sensing device 55 for determining the displacement position of the piston 8 or the piston rod 10.

The locking/unlocking device 54 serves for locking the drive ring 28 and thereby the inlet locking valves 34. To this end, the locking device 54 has a locking lever 56 that extends parallel to the longitudinal extent of the guide cylinder 5 at a small distance therefrom. The locking lever 56 is pivotally supported, at its rear end, on the outer side of the bottom wall 3*a*. To this end, a support bracket 57 is provided on the outside of the bottom wall 3*a*. At its opposite end, the locking lever 56 extends through and opening 58 formed in the drive ring 28 and carries the sensing device 55 at this end. The sensing device extends into the path of movement of the piston rod 10. The free end of the sensing device 55 is located immediately beneath the end surface 10*a* of the piston rod 10 when the piston 8 is in its initial position shown in FIG. 1. The locking lever 56 can be stamped out, e.g., of a sufficiently rigid metal sheet. At its side remote from the wall 6 of the guide cylinder 5, the locking lever 56 has a locking edge 59 which is adapted to engage the drive ring 28 from beneath when the drive ring 28 is pushed sufficiently far in the direction toward the bottom wall 3*a*. The width of the locking lever 56, starting from the support bracket 57, is relatively small, with the width increasing to from the locking edge 59. The locking lever 56 is pivoted about the support bracket 57 in a direction toward the guide cylinder 5 by a compression spring 60 provided on a side of the locking lever 56 remote from the guide cylinder 5. Upon the locking lever 56 being pivoted toward the guide cylinder 5, the locking edge 59 becomes disengaged from the edge of the opening 58, with the sensing device 55 having its free end located in the path of the piston rod 10.

As shown in FIG. 1, the sensing device 55 has a probe holder 65 pivotable about a pivot axle 66 provided at the free end of the locking lever 56. The probe holder 65 carries, at its end section adjacent to the piston rod 10, a probe stylus 67 pivotable about an axle 68 which is carried by the probe holder 65. A compression spring 69 is provided between and end of the probe stylus 67 remote from the piston rod 10 and a section of the probe holder 65 adjacent to the locking lever 56. The Compression spring 69 is supported against the probe holder 65 and tends to pivot the probe stylus 67 about the axle 68 in a clockwise direction. The pivotal movement of the probe stylus 67 in the clockwise direction is limited by a stop (not shown).

FIG. 1 shows a position of the setting rod in which the probe stylus 67 occupies a position in which its free tip projects into the path of the piston rod 10. The probe stylus 67 pivots in the opposite direction against a biasing force of the compression spring 69 to move out of the path of the piston rod 10. In this position, the probe stylus is pressed against the piston rod 10 radially.

In the embodiment shown in the drawings, the locking lever 56, which pivots about the axle of the support bracket 57, pivots in a plane in which the central axis of the piston rod 10 is located. The axle 66 is likewise located in this plane. However, the axle 66 extends transverse to the central axis of the piston rod 10. The axle 68, about which the probe stylus 67 pivots, extends transverse to the pivot plane of the locking lever 56.

An actuation element 70 (not shown in FIG. 1) provides for manual adjustment of the probe holder 65 about the pivot axle 66, as it will be discussed in detail further below with reference to FIGS. 7*a*–9*b*. By pivoting the probe holder 65 about the axle 66, the probe stylus 67 can be pivoted out of the plane of the drawing forward or backward, with the free end of the probe stylus 67 being located sidewise of the piston rod 10 in a spaced relationship thereto. The probe stylus 67 can be pressed against the piston rod 10 radially by appropriate pressure means (not shown). In the pivoted position of the probe holder 65 or the probe stylus 67, out of the plane of the drawing, no force is applied by the piston rod 10, via the probe stylus 67 and the probe holder 65, to the locking lever 56. The non-shown pressure means provides for a return pivotal movement of the probe holder 65 into a position in which the position of the piston rod 10 can be determined. The probe holder 65 or the probe stylus 67 are pivoted back into the initial position shown in FIG. 1 against a stop (not shown).

Sidewise of the guide cylinder 5, there is provided a trigger 61 which is pivotally supported on the outer side of the guide cylinder 5, on the wall 6. For a pivotal support of the trigger 61, there is provided a support bracket 62, with the trigger 61 being pivoted about the support bracket 62 in a direction toward the bottom 3*a,* 3*b* against a biasing force of a compression spring 63. The actuation section of the trigger 61 is located outside of the locking lever 56. In the region of the support bracket 62, the trigger 61 is formed integrally with a projection 64 extending in a direction toward the bottom 7 of the guide cylinder 5. When the trigger 66 is pivoted about the support bracket 62 counterclockwise, the projection 64 pivoted with the trigger 61, acts on the edge of the locking lever 56 facing the guide cylinder 5. The projection 64 displaces the locking lever 56 against the biasing force of the spring 60, pivoting the locking lever 56 about the support bracket 57 counterclockwise.

The operation of the inventive setting tool will now be described with reference to FIGS. 2–6 in which the same elements as in FIG. 1 are designated with the same reference numerals as in FIG. 1.

FIG. 2 shows a condition in which the setting tool is pressed with its front tip against an object in which a fastening element is to be driven. By a mechanism (not shown) provided at the front end to the tool, the drive ring 28 is displaced in a direction toward the combustion chamber 1, and the drive rods 23 expand the fore-and main chambers 21, 22 and close the inlet/outlet valves 34. Shortly before a complete expansion of the fore-and main chambers 21, 22, a liquefied fuel gas is injected thereinto through the radial openings 41, 42. In its press-on end position, the drive ring 28 is located in front of the locking edge 59, however, the locking edge 59 cannot yet engage the drive ring 28 from behind as the trigger 61 has not yet been actuated. Therefore, the free end of the probe stylus 67 is still located in the path of the piston rod 10, i.e., in front of the end surface 10*a* of the piston rod 10.

Figure 3:
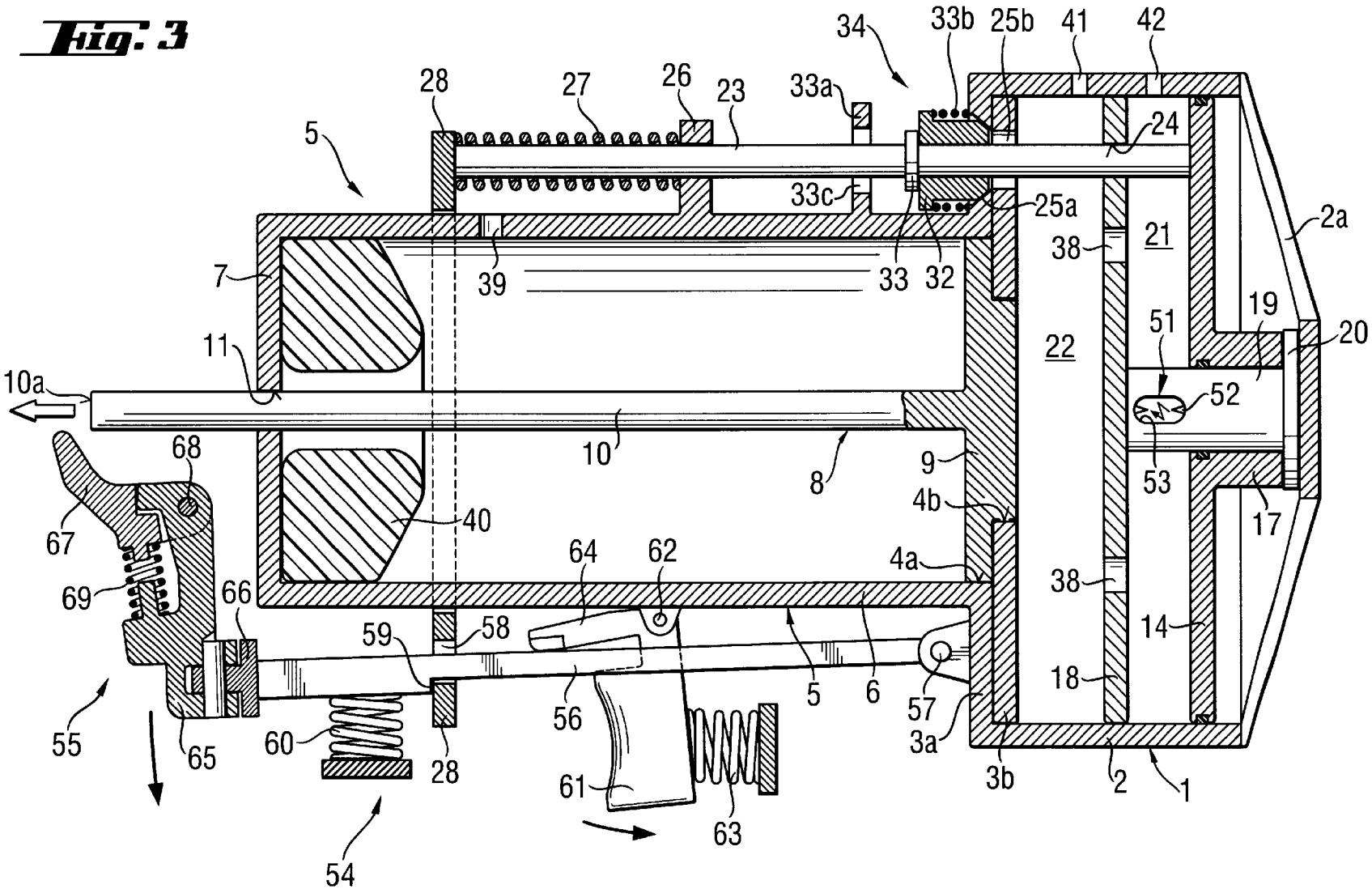
FIG. 3 an axial cross-sectional view of the setting tool shown in FIG. 1 in a press-on condition of the setting tool, with an ignited combustion chamber.

FIG. 3 shows the position of the setting toll in which the trigger 61 is actuated, i.e., is pivoted counterclockwise about the support bracket 62 against the biasing force of the spring 63. In this position of the trigger 61, the projection 64 pivots the locking lever 56 about the support bracket 57 also counterclockwise, and the locking edge engages the drive ring 28 from beneath. Simultaneously with the pivotal movement of the locking lever 56, the probe stylus 67 moves out of the displacement path of the piston rod 10. At the end of the pivotal movement of the trigger 61 and after the probe stylus 67 has moved out of the displacement path of the piston rod 10, an ignition of the fuel gas mixture, which is present in the force-and main chambers 21, 23 is effected with the ignition device 52 which generates an ignition spark. A fuel mixture, which was previously formed in the chambers 21, 22, e.g., an air-fuel gas mixture, starts to burn laminary in the forechamber 21, with a flame front propagating radially, with a comparatively slow speed, in a direction toward the openings 38. The flame front displaces the unconsumed air-fuel gas mixture ahead of it. The mixture enter through the openings 38 into the main chamber 22, creating there turbulence and pre-compression. As the flame front reaches the openings 38, the flame penetrates therethrough, due to the small cross-section of the openings 38, in a form of flame jets into the main chamber 22, creating there a further turbulence. The thoroughly intermixed air-fuel gas mixture in the main chamber 22 ignites over the entire surface of he flame jets. The mixture bums with high speed which leads to a sharp increase of pressure in the main chamber 22.

This pressure acts on the piston plate, and the piston 8, which moves with a high speed toward the bottom 7 of the guide cylinder 5, forcing the air from the guide cylinder 5 out through the openings 39. Upon the piston plate 9 passing the openings, 39, the exhaust gas is discharged therethrough. The piston rod 10 movable in the direction shown with arrow effects setting of a fastening element in the object against which the setting tool is pressed. Shortly after the ignition of the fuel gas mixture, the trigger 66 can be released. During the movement of the piston rod 10 in a direction shown with the arrow in FIG. 3, the locking lever 56, together with the sensing devise 55, is pressed by the compression spring 60 in a direction toward the guide cylinder 5. However, the locking edge 59 does not disengage from the drive ring 28 as the free end of the probe stylus 67 is pressed against the circumference of the piston rod 10, which makes a pivotal movement of the locking lever 56 about the support bracket 57 in the clockwise direction impossible. Thereby, the drive ring 28 retains its position, and the inlet/outlet valves 34 remain closed and the fore-and main chambers 21, 22 are in their expanded condition.

Figure 4:
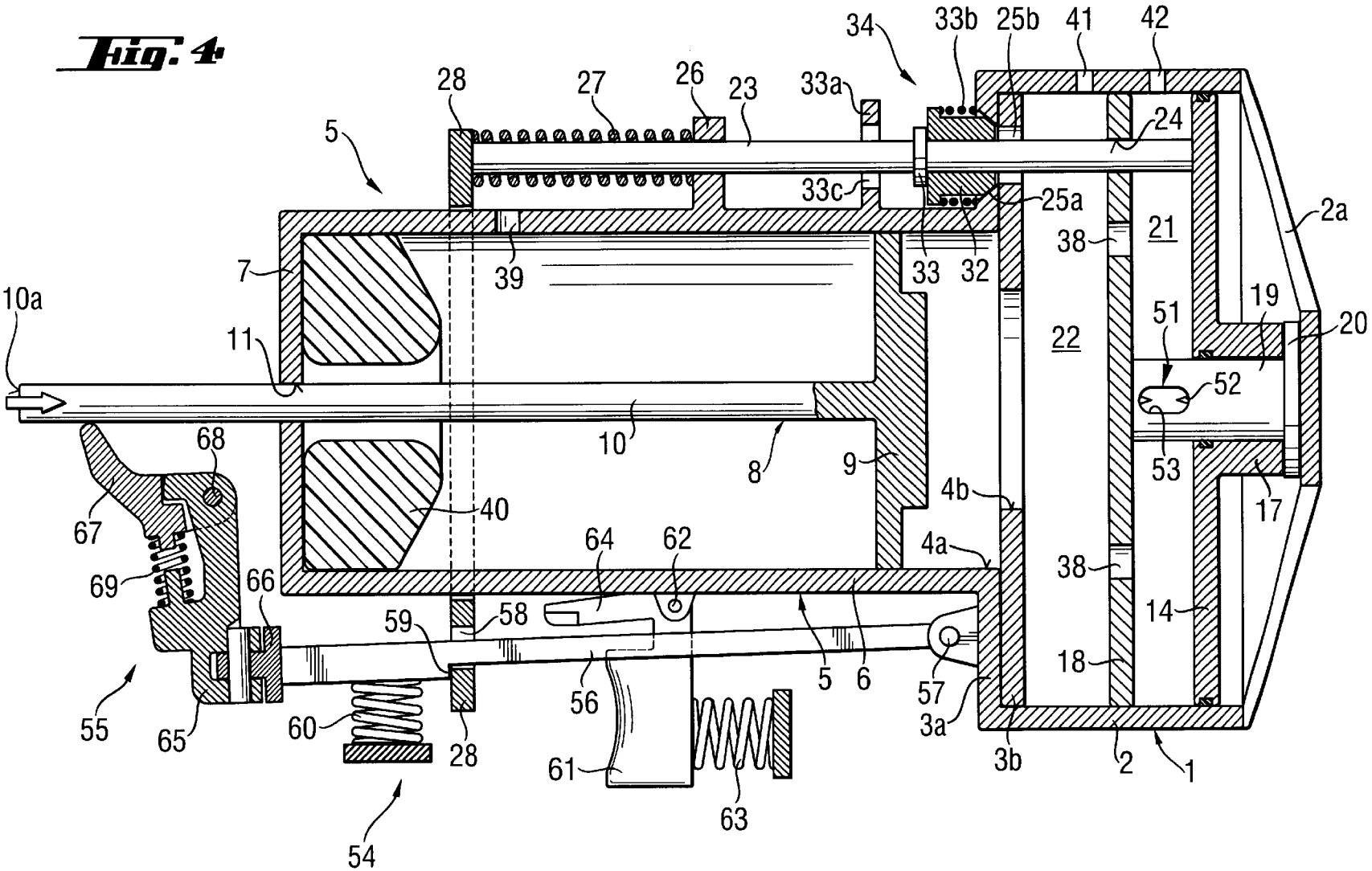
FIG. 4 an axial cross-sectional view of the setting tool shown in FIG. 1 in a condition of return of the tool piston to its initial position.

FIG. 4 shows a condition of the setting tool after completion of the setting process or completion of the combustion of the air-fuel gas mixture in the main chamber 22, when the piston 8 is displaced to its initial position, as a result of thermal feedback produced by cooling of the fuel gases which remain in the combustion chamber 1 and the guide cylinder 5. As a result of cooling of the fuel gases, and underpressure is created behind the piston 8 which provides for return of the piston 8 into its initial position. The probe stylus 67 slides along the circumferential surface of the piston rod 10, so that the drive ring 28 remains locked by the locking edge 59. The valves 34 remain also closed, as the piston 8 has not yet reached its initial position.

Figure 5:
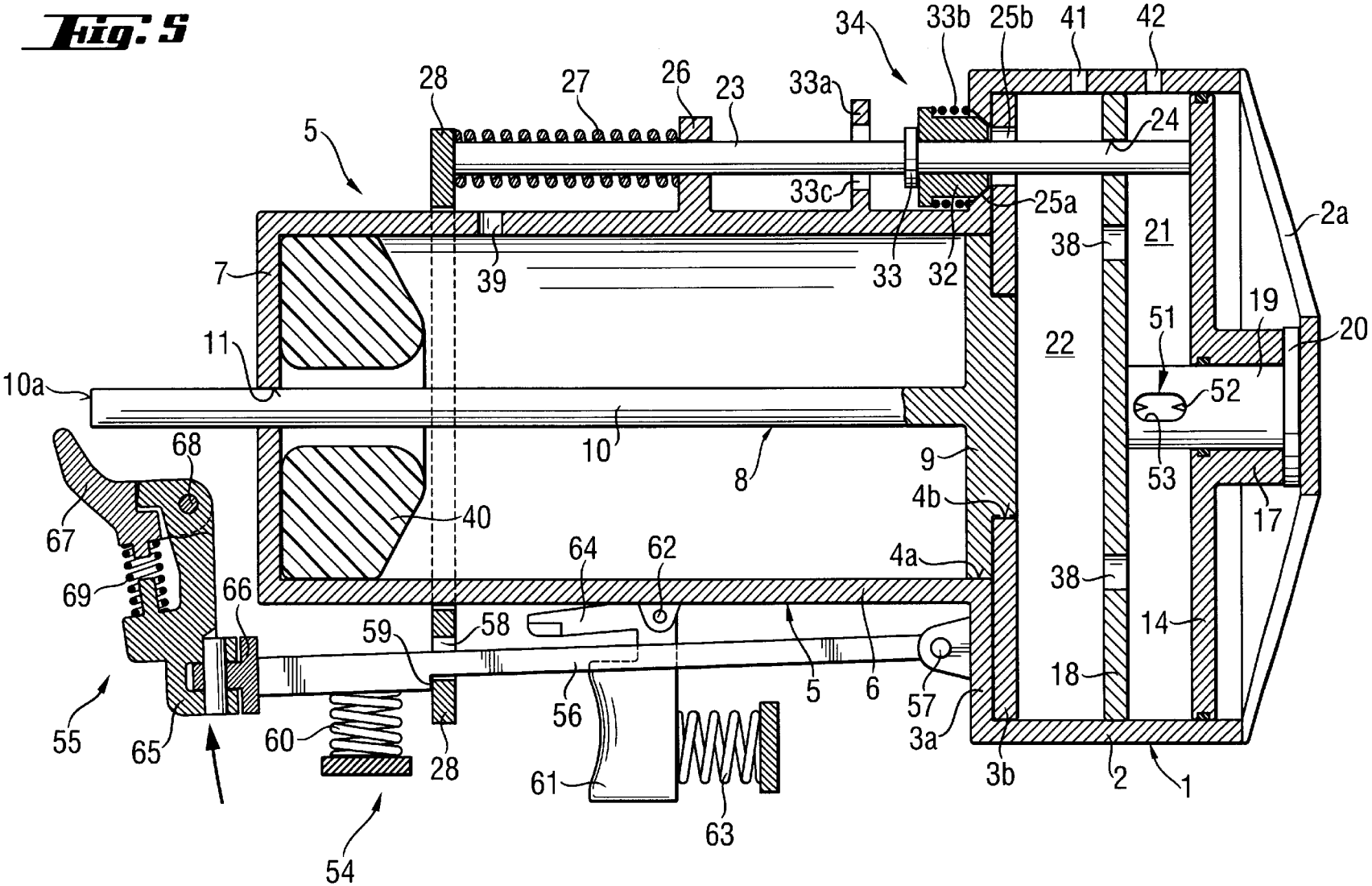
FIG. 5 an axial cross-sectional view of the setting tool shown in FIG. 1 in which the tool piston has returned to its initial position.
Figure 6:
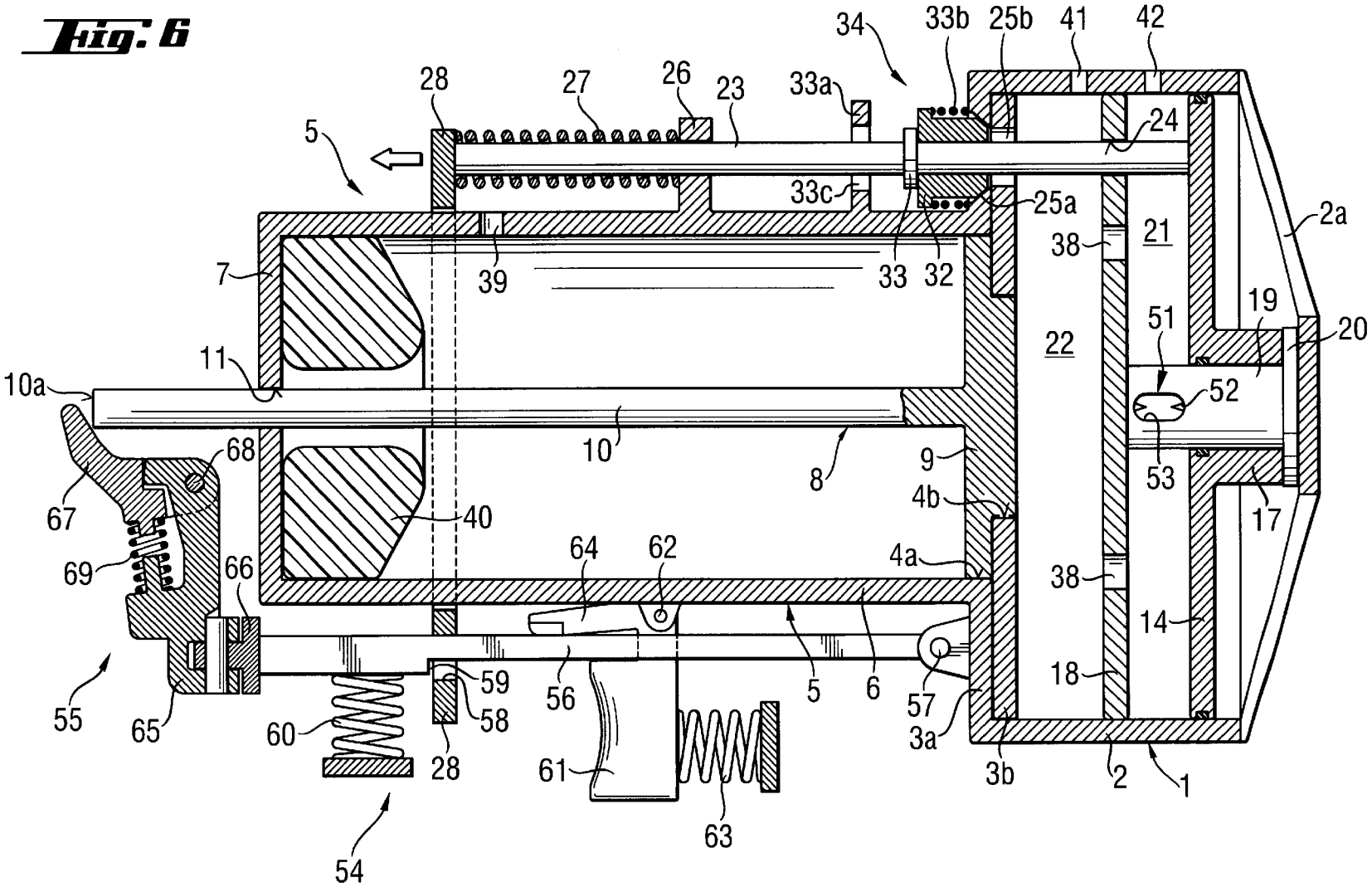
FIG. 6 an axial cross-sectional view of the setting tool shown in FIG. 1 in the tool unlocked condition.

FIG. 5 shows a condition of the setting tool in which the piston 8 has reached its initial position. In this position of the piston 8, the openings 4*a*, 4*b* are completely closed by the piston plate 9. The free end of the piston rod 10*a* is so far retracted into the guide cylinder 5 that its end surface 10*a* is located above the region of the free end of the probe styles 67. In this position of the piston 8, the compression spring 60 pivots the locking lever 56, together with the sensing device 55, clockwise, and the locking edge 59 becomes disengaged from the drive ring 28.

In the following step (not shown in the drawings the compression springs 57 bias the drive ring 28 away from the bottom 3*a*, 3*b*, together with the drive rods 23. With the displacement of the shoulders 33, which are provided on drive roads 23, away from the bottom 3*a*, 3*b*, the valve tappets 32 move out of the openings 25*a* under the action of the compression springs 33*b*. As the drive rods 23 move away toward the front end of the setting tool, the drive rods 23 pull the movable wall 14 and, thereafter, the separation plate 18, toward the bottom 3*a*, 3*b*, so that the combustion chamber 1 or the fore-and main chambers 21, 22 collapse. The flue gases are expelled through the inlet/outlet valves 34 which also admit fresh air into the combustion chamber 1 when the movable wall 14 and the separation plate move away from the bottom 3*a*, 3*b*.

Below, with reference to FIG. 4, it would be described what takes place when the piston 8 after the setting process does not reach its initial position, i.e., the piston 8 occupies a faulty position which is shown in FIG. 4.

Figure 7A:
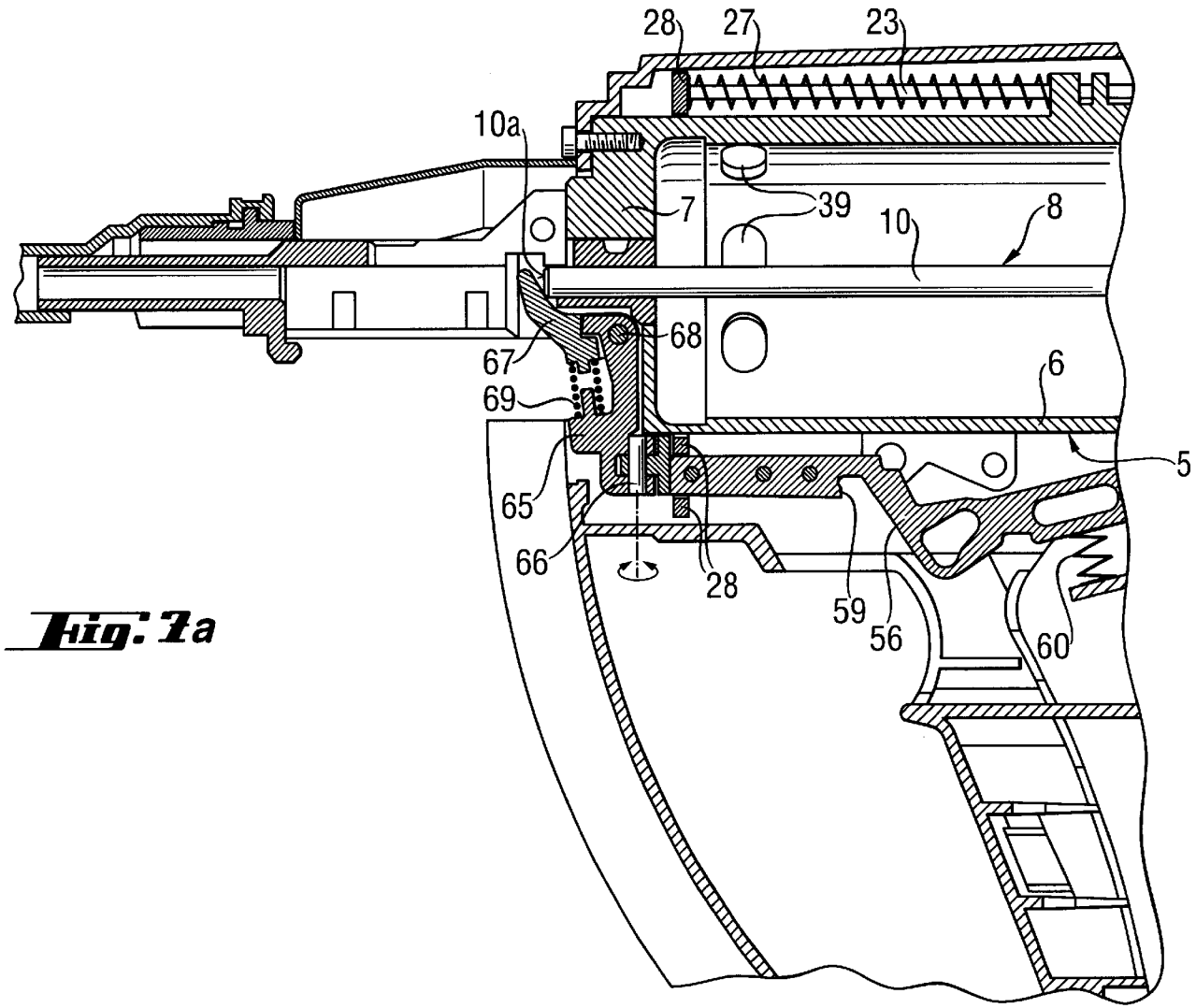
FIG. 7*a* a partial axial cross-sectional view of the setting tool shown in FIG. 1 in the tool original position.
Figure 7B:
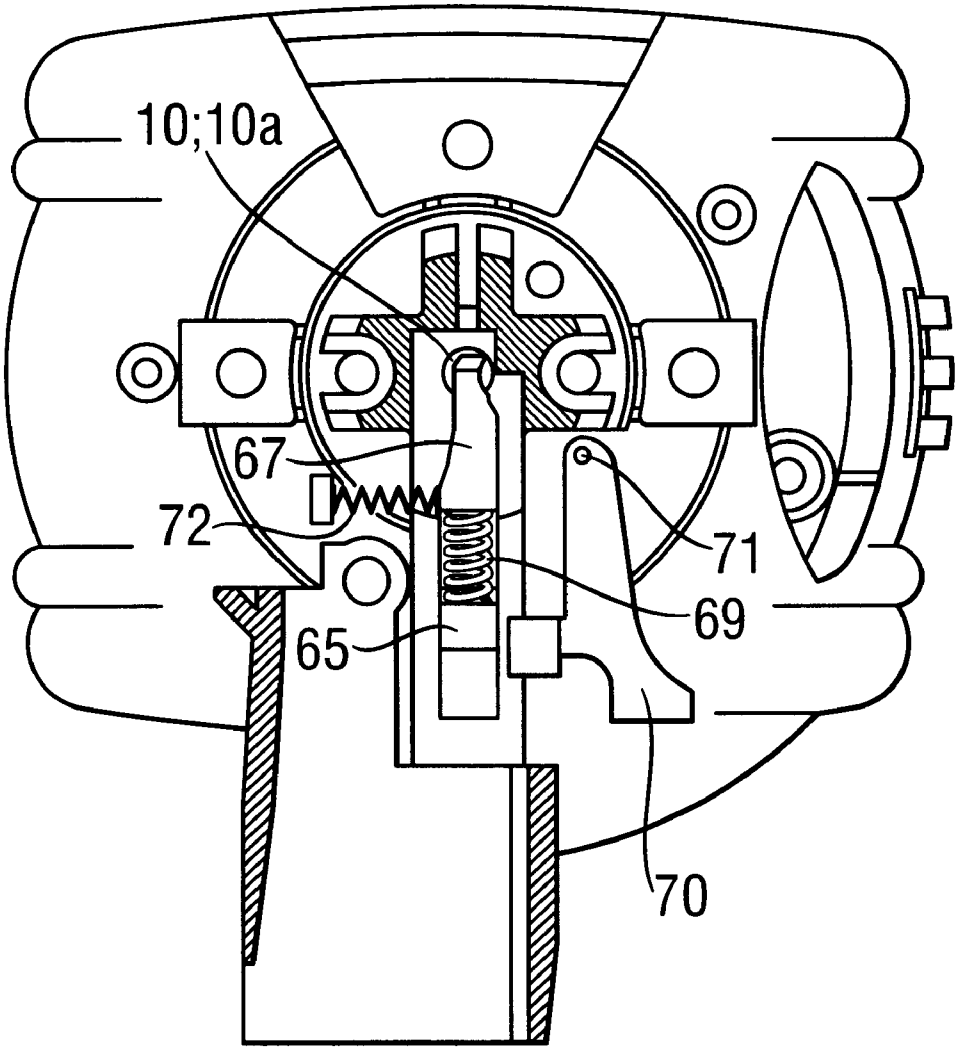
FIG. 7*b* a partial cross-sectional view of the setting tool shown in FIG. 1, which the cross-sectional view being taken perpendicular to the tool axis.
Figure 8A:
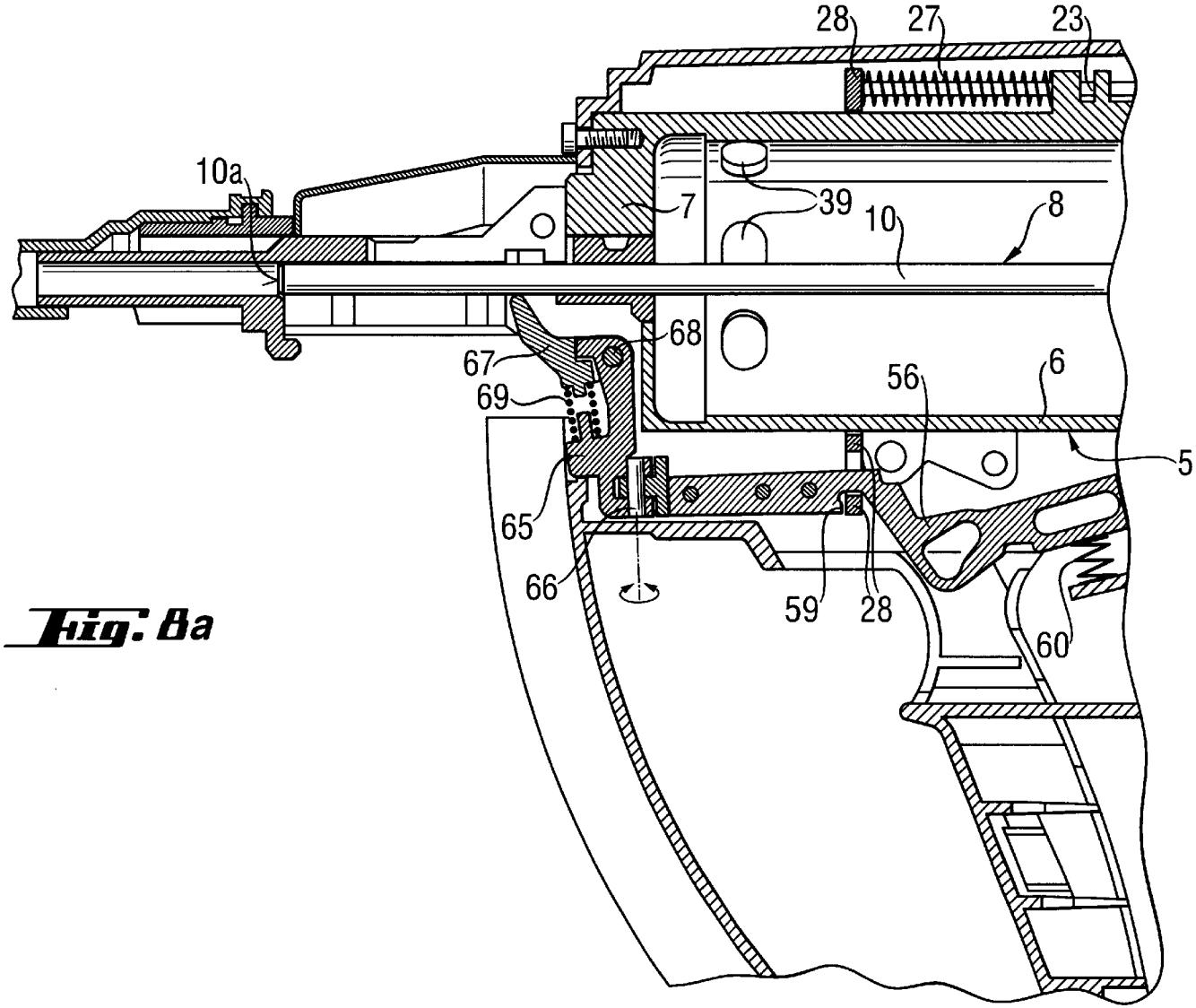
FIG. 8*a* a cross-sectional view similar to that of FIG. 7*a* and in which the tool piston has not yet returned to its initial position and the locking/unlocking device is in its locking position.
Figure 8B:
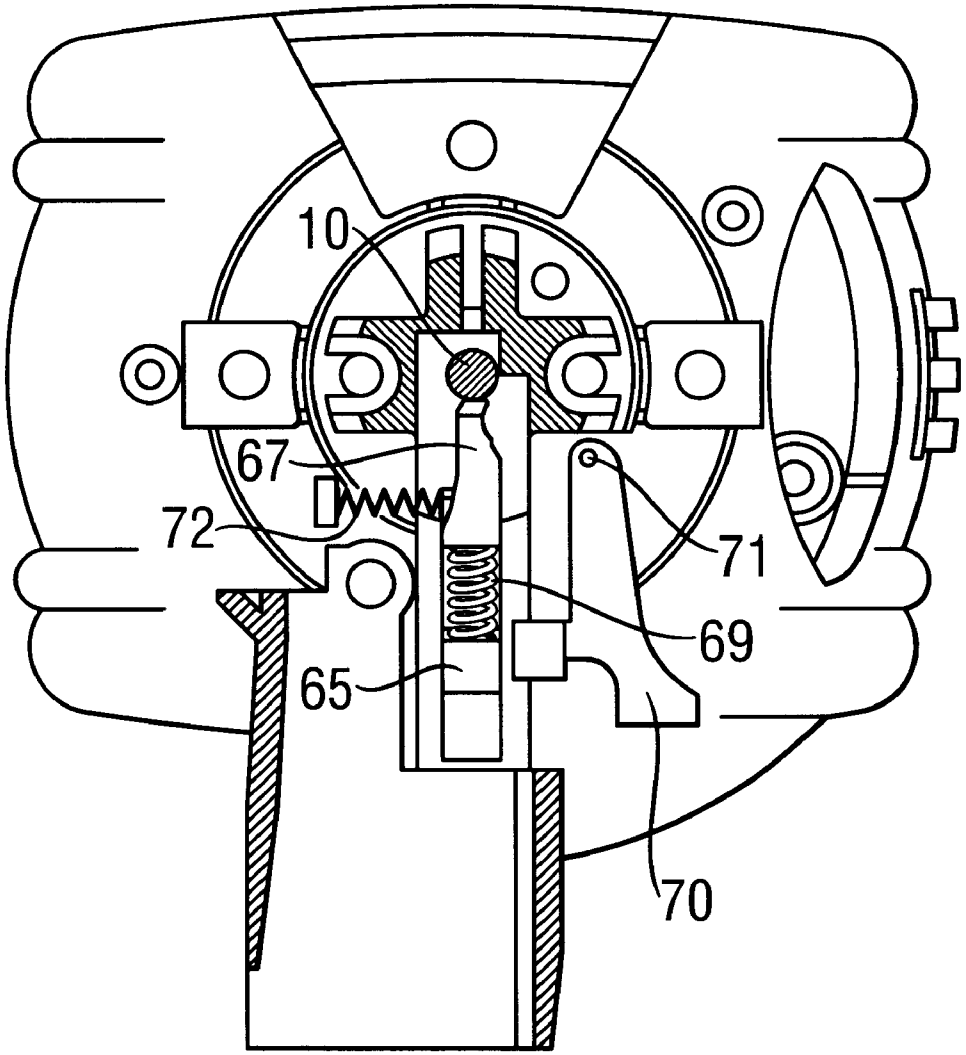
FIG. 8*b* a cross-sectional view similar to that of FIG. 7*b* and in which the tool piston has not yet returned to its initial position and the locking/unlocking device is in its locking position.
Figure 9A:
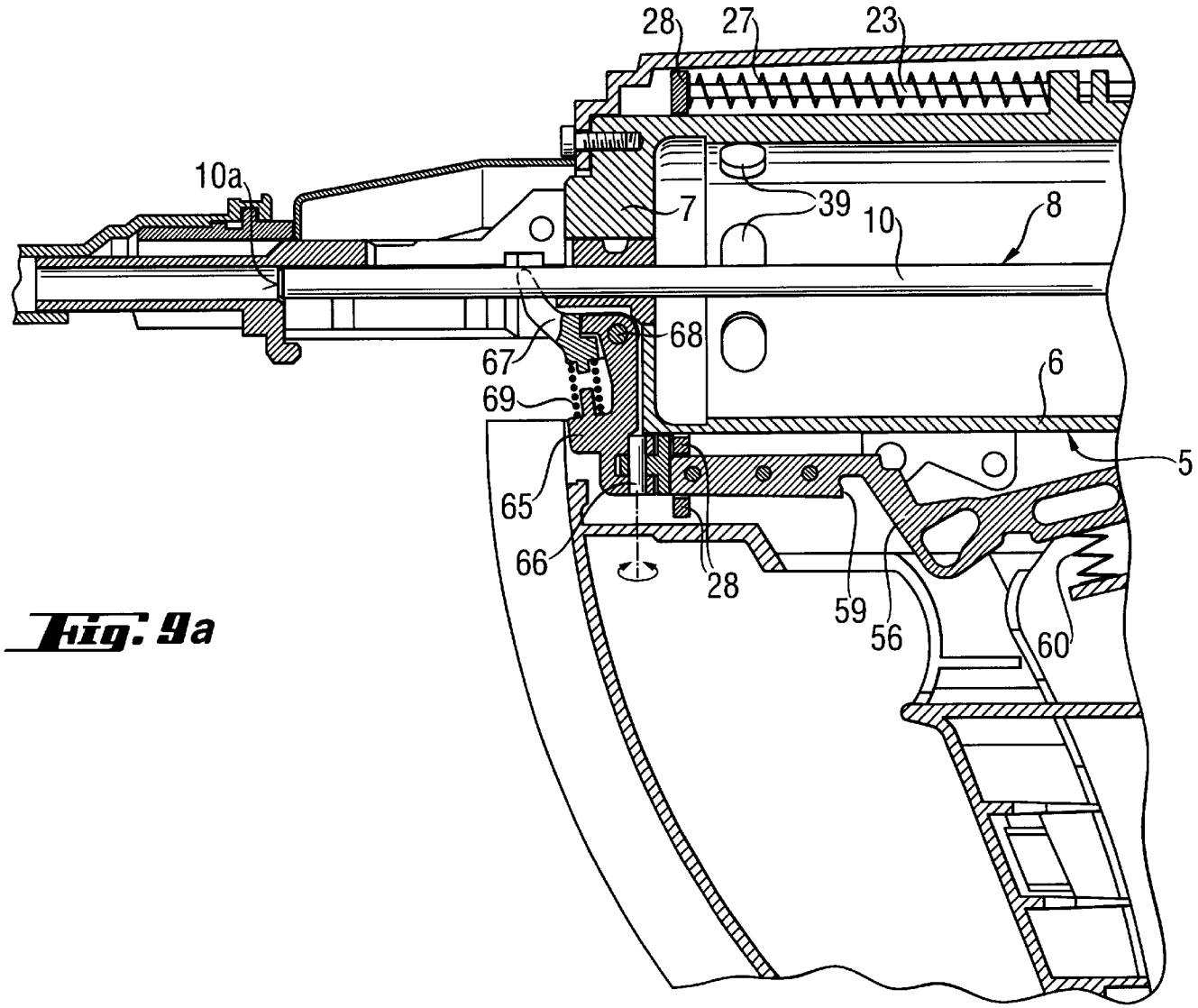
FIG. 9*a* a cross-sectional view similar to that of FIG. 8*a* and in which the tool piston has not yet returned to its initial position and the locking/unlocking device is in its unlocking position.
Figure 9B:
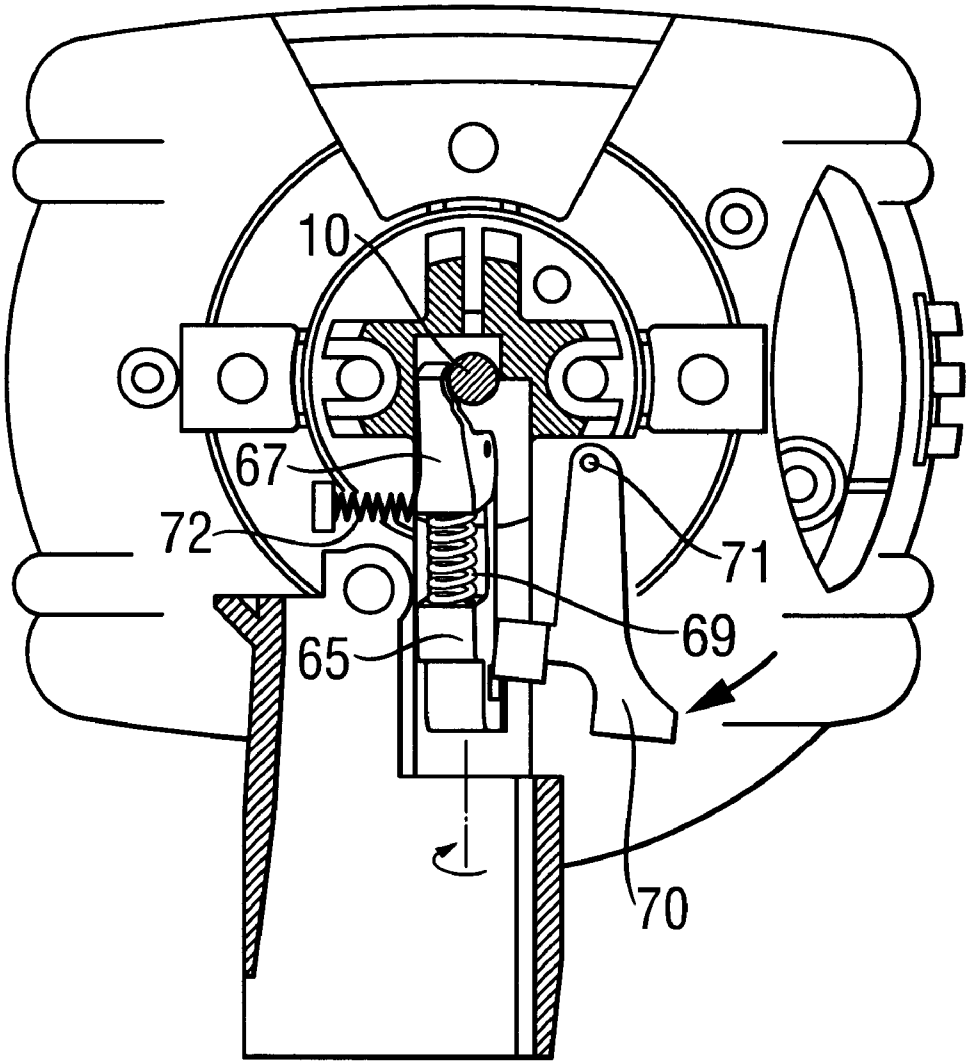
FIG. 9*b* a cross-sectional view similar to that of FIG. 8*b* and in which the tool piston has not yet returned to its initial position and the locking/unlocking device is in its unlocking position.

In the case the piston 8 does not reach its initial position, the probe holder 65 is manually pivoted about the axle 66 with the actuation element 70 shown in FIGS. 7*b*, 8*b*, 9*b*. The operational direction of the actuation element 70 in FIG. 4 extends transverse to the plane of the drawing. Assume, e.g., that the actuation element 70 pivots the probe holder 65 in FIG. 4 about the axle 66 backward, i.e., into the plane of the drawing. As the piston rod 10 has a circular cross-section, together with the pivotal movement of the probe holder 65 about the axle 66, the probe stylus 67 would also pivot clockwise about the axle 68 until it engages a stop (not shown) provided on the probe holder 65 and occupies its end position shown in FIG. 1. In the condition shown in FIG. 4, the free end of the probe stylus 67 is located sidewise of the piston rod 10. This means that the probe stylus 67 is not any more supported radially against the piston rod 10, so that no force can be transmitted by the probe stylus 67 to the locking lever 56 for retaining the locking lever 56 in its locking position. Rather, the spring 60 biases the locking lever 56 to its unlocking position. As a result, the drive ring 28 can move past the locking edge 59, opening the inlet/outlet valves 34. Though the piston 8 has not reached its initial position, the setting tool is ready for the next setting process. Upon the initiation of the next setting process, by pressing the setting tool against an object into which a fastening element is to be driven in, the drive ring 28 is again displaced into the position shown in FIG. 4, however, no force acts on the locking lever 56 in the locking direction of the locking lever 56. Rather, the spring 60 retains the locking lever 56 in its unlocking position, i.e., in the position shown in FIG. 2. The steps, which were discussed with reference to FIGS. 2–3, can be repeated again in order to bring the piston 8 into its initial position.

An interim idle setting stroke is not any more possible. This is because starting from the condition shown in FIG. 4 and with the probe holder 65 being pivoted out, upon the initiation of the next setting step by pressing the setting tool against an object, no positive locking of the locking lever 56 takes place as the sensing device 55 is in a non-operative position. If in this condition, the setting tool is taken away from the object, without the ignition taken place, which can be caused by actuation of the trigger, the drive ring 28 immediately moves past the locking edge 59, which insures that no setting stroke can take place after the setting tool has been taken off the object.

FIGS. 7*a*–9*b* show in somewhat more detail the sensing device 55. The elements, which are the same as in FIGS. 1–6, are designated with the same reference numerals and would not be discussed further.

The condition shown in FIGS. 7*a*–7*b* corresponds to the condition shown in FIG. 1. The setting tool is in its off position, and the actuation element 70 in FIG. 7*b* is not in its deflected position. The actuation element 70 is formed as pivot lever pivotal about an axle 71 in a plane that extends transverse to the longitudinal direction of the piston rod 10. The axle 71, however, extends parallel to the longitudinal direction of the piston rod 10. The actuation element 70 pivots the probe holder 65 about the axle 66.

FIGS. 8*a,* 8*b* show the condition of the setting tool after it has been pressed against an object and the ignition has been initiated. This condition corresponds to the condition shown in FIG. 4. The probe stylus 67 applies pressure radially from below to the piston rod 10 and transmits the pressure force to the locking lever 56, retaining the locking lever 56 in its locking condition. The locking edge 59 engages from beneath the drive ring 28.

In order to bring the locking/unlocking device 54 or the locking lever 56 in the unlocking position, the actuation element 70 is pivoted about the axle 71, whereby the probe holder 65 is pivoted about the axle 66, as shown in FIGS. 9*a*–9*b*. As a result, the probe stylus 67 is located sidewise of the piston rod 10 and cannot transmit any pressure to the locking lever 56. The probe stylus 67 does not anymore apply any pressure to the piston rod 10. In this position of the probe stylus 67, the spring 60 biases the locking lever 56 to its unlocking position, and the drive ring 28 can be displaced toward the front end of the setting tool, whereby the inlet/outlet valves 34 are open. After the completion of a setting process, as a rule, the piston 8, together with the piston rod 10, returns to its initial position. In this condition of the piston 8, the piston rod 10 does not interfere with the probe stylus 67, and the probe stylus 67 can again be pivoted form behind into the plane of the drawing, which is effected with preload means 72 (FIG. 96). The preload means 72 is formed as a compression spring. In this position, the probe stylus 67 is located in the path of the piston rod 10, occupying the position shown in FIGS. 7*a*–7*b,* extending radially with respect to the piston road 10.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A portable, internal combustion-engined, setting tool for driving in fastening elements, the setting tool comprising a drive piston (8) having a piston rod (10) for driving a fastening element; a combustion chamber (1) located adjacent to the piston (8) and in which a fuel gas mixture is ignited for generating pressure for driving the piston (8); at least one outlet valve (34) provided in the combustion chamber (1) for removing flue gases; a locking/unlocking device (54) for closing and opening the at least one outlet valve (34), respectively; sensing means (55) for retaining the locking/unlocking device (54) in a locking position and having a member that is pressed against a circumference of the piston rod (10) for retaining the locking/unlocking device (54) in the locking position and that is displaced, after the piston (8) reaches an initial position thereof, into a path of the piston rod (10) to enable displacement of the locking/unlocking device (54) from the locking position into an unlocking position; and means for positioning the member relative to the piston rod (10) when the piston (8) is not in the initial position thereof, so that the member does not apply to the locking/unlocking device (54) a force acting in a locking direction of the locking/unlocking device (54).

2. A setting tool according to claim 1, wherein the member is positioned on a side of the piston rod (10) when viewed in a press-on direction.

3. A setting tool according to claim 2, further comprising preload means (72) for biasing the member toward the piston road (10).

4. A setting tool according to claim 1, wherein the locking/unlocking device comprises a locking lever, and wherein the sensing means is pivotally supported on the locking lever.

5. A setting tool according to claim 1, wherein the positioning means comprises an actuation element for displacing the member.

* * * * *